US005977929A

United States Patent [19]

Ryken

[11] Patent Number: 5,977,929

[45] Date of Patent: Nov. 2, 1999

[54] POLARIZATION DIVERSITY ANTENNA

[75] Inventor: Marvin L. Ryken, Ventura, Calif.

[73] Assignee: The United States of America as represented by the Secretary of the Navy, Washington, D.C.

[21] Appl. No.: 09/119,174

[22] Filed: Jul. 2, 1998

[51] Int. Cl.[6] ..... H01Q 21/26

[52] U.S. Cl. ..... 343/797; 343/876

[58] Field of Search ..... 343/797, 793, 343/753, 756, 853, 876, 795; 342/188

[56] References Cited

U.S. PATENT DOCUMENTS 4,062,019 12/1977 Woodward et al. ..... 343/797
4,410,891 10/1983 Schaubert et al. ..... 343/700 MS
4,814,777 3/1989 Monser ..... 343/799
5,337,058 8/1994 Cross ..... 342/188
5,828,344 10/1998 Alder et al. ..... 343/756

*Primary Examiner*—Don Wong
*Assistant Examiner*—Tan Ho
*Attorney, Agent, or Firm*—David Kalmbaugh

[57] ABSTRACT

A crossed-dipole antenna having four antenna elements, the polarization of which is easily changed from vertical linear polarization to horizontal linear polarization. A switching network coupled to the crossed-dipole antenna includes pin diodes operating as radio frequency switching elements which provide a means for electronically switching the polarization of the crossed-dipole antenna. A positive biased voltage applied to the switching network results in the crossed-dipole antenna being polarized linearly in a horizontal direction. A negative biased voltage applied to the switching network results in the crossed-dipole antenna being polarized linearly in a vertical direction.

6 Claims, 4 Drawing Sheets

POLARIZATION DIVERSITY ANTENNA

BACKGROUND OF THE INVENTION

1. Field of the Invention

The present invention relates generally to antenna polarization diversity. More specifically, the present invention relates to a switching circuit which allows for the reconfigurability of a cross-dipole antenna to provide for different polarizations and reduced radar cross section of the antenna.

2. Description of the Prior Art

In the antenna art it is often very desirable, especially when dealing with projectiles, missiles, military aircraft and the like, to be able to construct antennas which exhibit a selectable radiation polarization while maintaining a desirable aerodynamic profile or reduced radar cross section.

For example, in the past polarization diversity was achieved by using a dual-polarized antenna or an antenna with a mechanically rotating feed line. Dual-polarized antennas are generally very complex and also have excessive power requirements which can be very costly. Mechanical devices for achieving polarization diversity are generally unreliable due to mechanical breakdowns.

In addition, in the past there has often been a need to use power dividers, phase shifters and RF switches to provide for antennas which exhibit selectable radiation polarization. Thus, it would be highly desirable to construct an antenna which would provide polarization diversity without the necessity of power dividers, phase shifters, etc.

SUMMARY OF THE INVENTION

The present invention overcomes some of the disadvantages of the prior art including those mentioned above in that it comprises a relatively simple yet highly effective crossed-dipole antenna and its associated switching network which allows for polarization diversity of the radiation pattern emitted by the crossed-dipole antenna.

The crossed-dipole antenna has four antenna elements, the polarization of which is easily changed from vertical linear polarization to horizontal linear polarization. A switching network coupled to the crossed-dipole antenna includes pin diodes operating as radio frequency switching elements which provide a means for electronically switching the polarization of the crossed-dipole antenna. A positive biased voltage applied to the switching network results in the crossed-dipole antenna being polarized linearly in a horizontal direction. A negative biased voltage applied to the switching network results in the crossed-dipole antenna being polarized linearly in a vertical direction.

DETAILED DESCRIPTION OF THE PREFERRED EMBODIMENT

Figure 1:
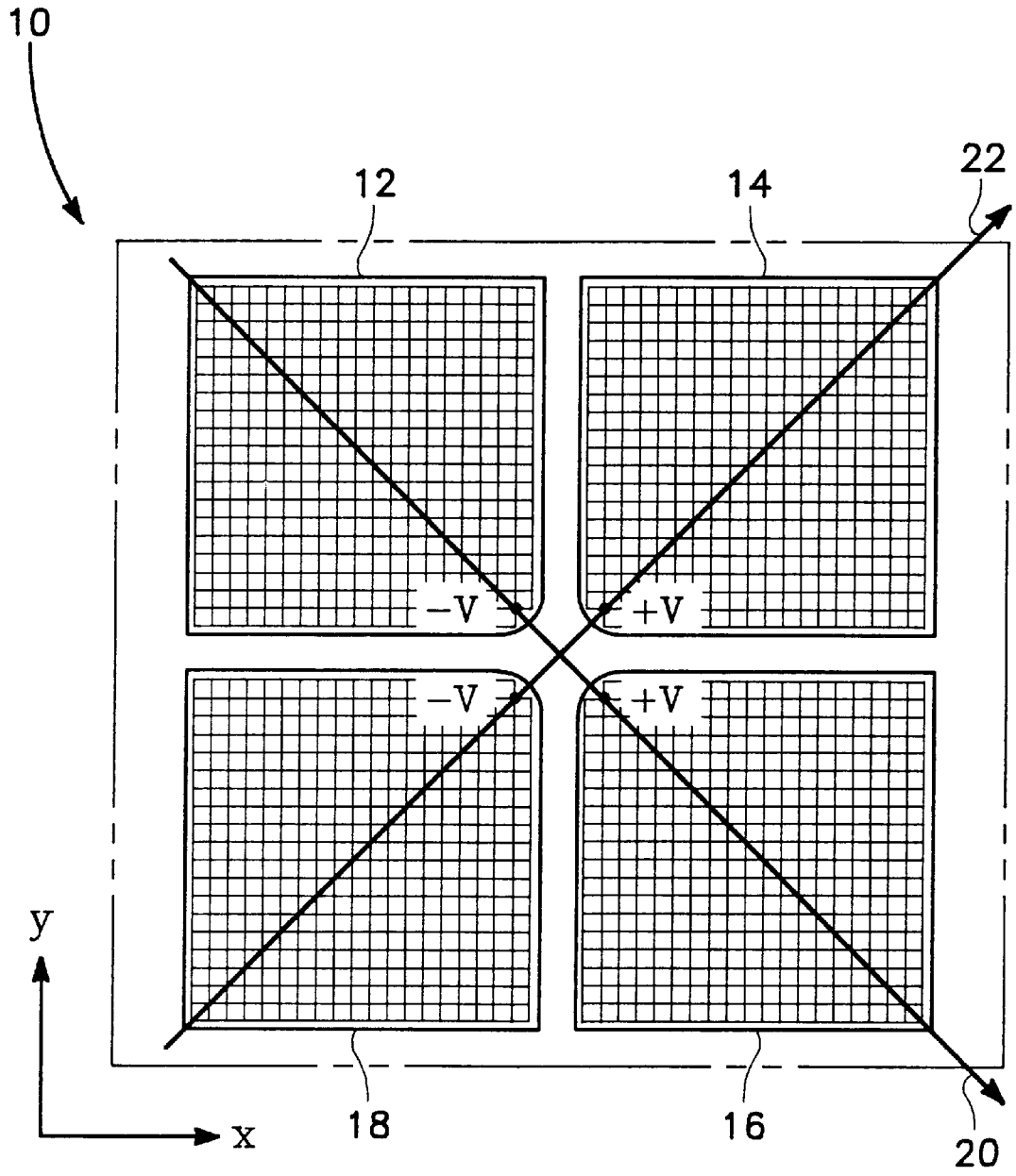
FIG. 1 illustrates a crossed-dipole antenna which is used to provide selectable radiation polarization.

Referring first to FIG. 1, there is shown a crossed-dipole antenna 10, which is generally rectangularly shaped and which provides for two orthogonal polarizations of radio frequency signals transmitted by antenna 10. Crossed-dipole antenna 10 includes antenna elements 12, 14, 16 and 18 with antenna elements 12 and 16, which are diagonally positioned, comprising one dipole of crossed-dipole antenna 10. Antenna elements 14 and 18, which are also diagonally positioned, comprise the second dipole of crossed-dipole antenna 10. As shown in FIG. 1 antenna elements 12 and 16 are positioned at angle of −45° with respect to the horizontal or x-axis, while antenna elements 14 and 18 are positioned at angle of +45° with respect to the horizontal axis.

As shown in FIG. 1, crossed-dipole antenna 10 is positioned so that its two dipoles provide two orthogonal polarizations. One dipole of crossed dipole antenna 10 comprises antenna elements 12 and 16, while the second dipole of cross dipole antenna comprises antenna elements 14 and 18.

A negative voltage applied to antenna element 12 and a positive voltage applied to antenna element 16 results in a −45 degree linear polarization as indicated by arrow 20. Similarly, a positive voltage applied to antenna element 14 and a negative voltage applied to antenna element 18 results in a +45 degree linear polarization as indicated by arrow 22.

Figure 2:
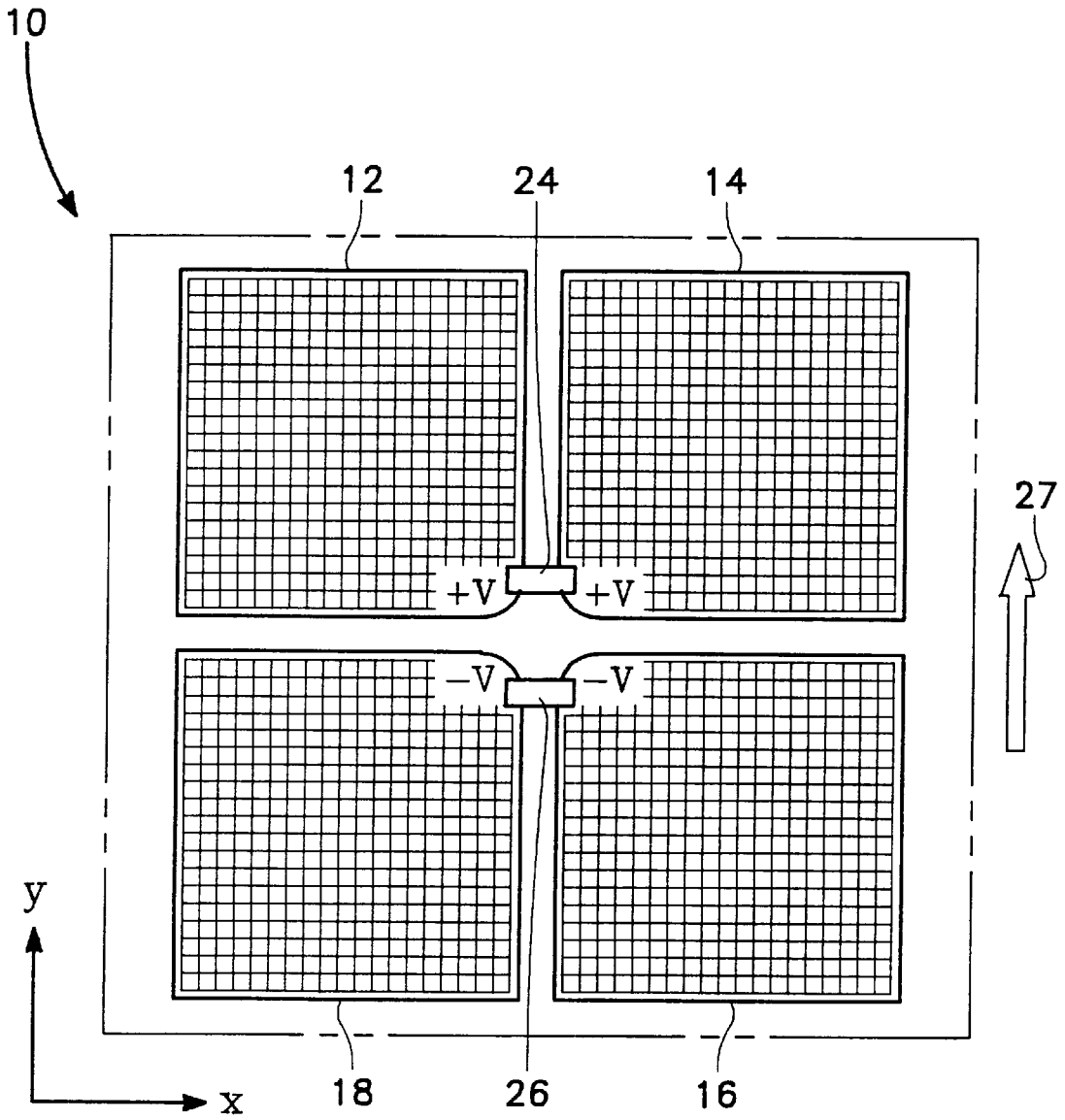
FIG. 2 illustrates the crossed-dipole antenna of FIG. 1 configured to provide vertical linear polarization.

Referring now to FIGS. 1 and 2, a coupling element 24 is used to connect antenna elements 12 and 14 and a coupling element 26 is used to connect antenna elements 16 and 18.

Using coupling elements 24 and 26 results in vertical linear polarization (as indicated by arrow 27) of crossed-dipole antenna 10.

Figure 3:
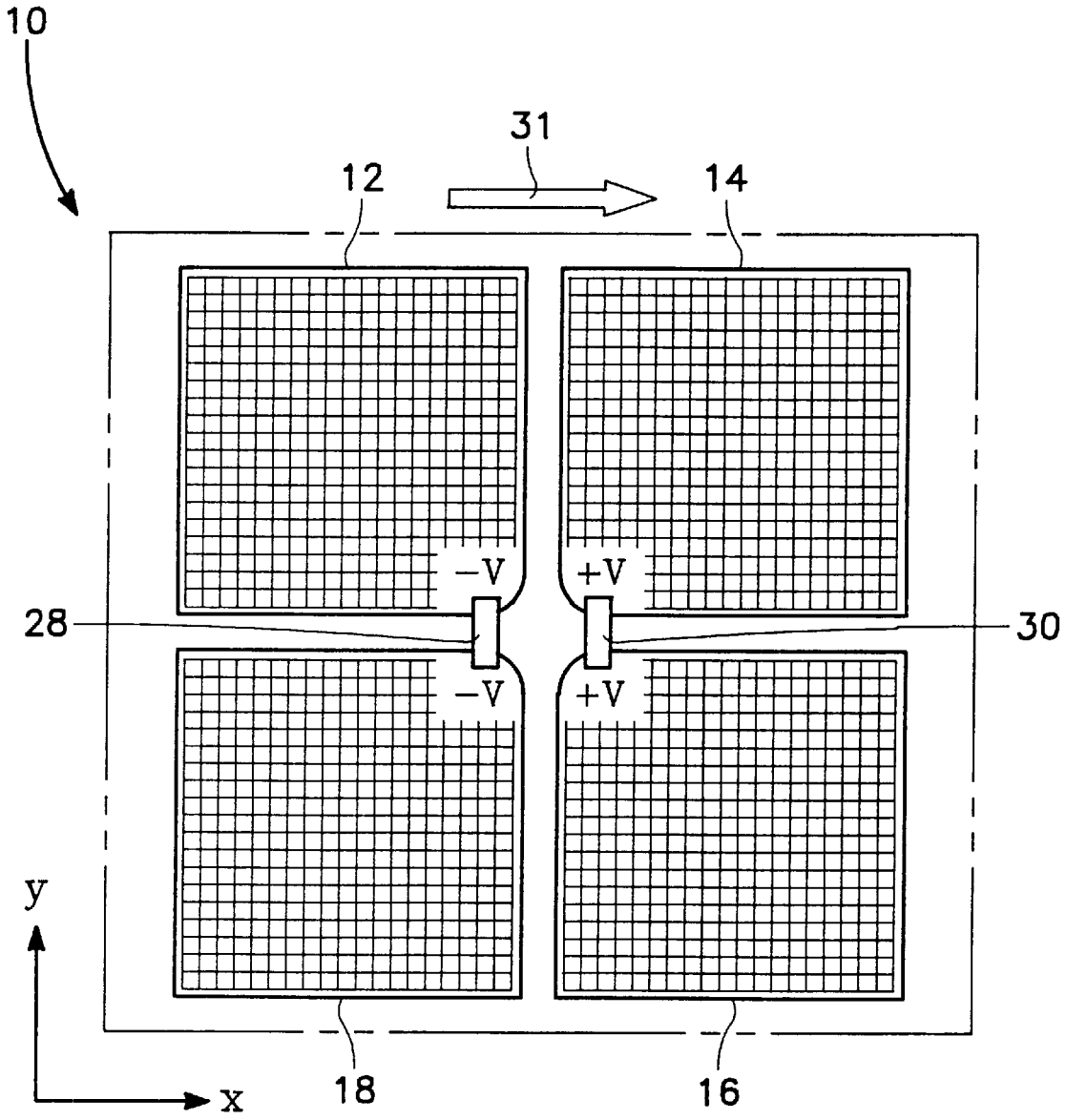
FIG. 3 illustrates the crossed-dipole antenna of FIG. 1 configured to, provide horizontal linear polarization.

Referring now to FIGS. 1 and 3, a coupling element 28 is used to connect antenna elements 12 and 18 and a coupling element 30 is used to connect antenna elements 14 and 16. Using coupling elements 28 and 30 results in horizontal linear polarization (as indicated by arrow 31) of crossed-dipole antenna 10.

Figure 4:
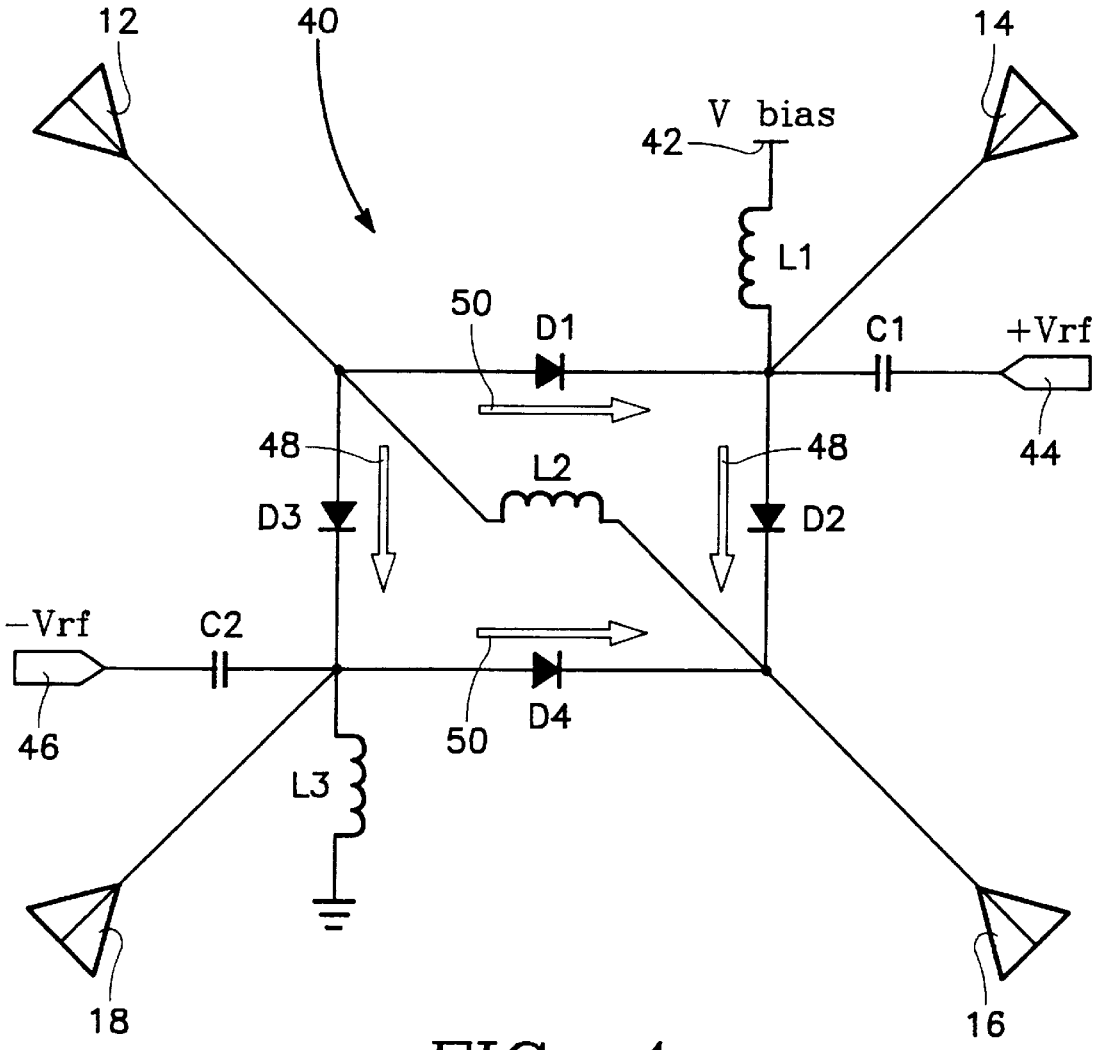
FIG. 4 is an electrical schematic diagram illustrating a switching network for crossed-dipole antenna of FIG. 1.

Referring to FIGS. 1 and 4, there is shown a switching network/circuit 40 which is used to control the operation of crossed-dipole antenna elements 12, 14, 16 and 18 to provide vertical linear polarization 27 (FIG. 2) and horizontal linear polarization 31 (FIG. 3). Switching circuit 40 includes a voltage source 42 which supplies positive and negative direct current voltages to switching circuit 40. Switching circuit 40 also includes a pair of DC blocking capacitors C1 and C2 and a trio of radio frequency signal blocking inductors L1, L2 and L3.

Capacitor C1 is connected to a positive RF signal input terminal 44, while capacitor C2 is connected to a negative RF signal input terminal 46, to block direct current flow to terminals 44 and 46. In a like manner, inductor L1 is connected to voltage source 42 to block RF signal flow to source 42, while inductor L3 is connected to ground to block RF signal flow to ground.

Pin diodes D1, D2, D3 and D4 operate as the radio frequency switching diodes or elements in switching network 40.

When switching circuit 40 is positively biased pin diodes D2 and D3 are turned on, while pin diodes D1 and D4 are turned off. This results in a RF signal flow path through diode D2 and diode D3 of switching circuit 40 as is best indicated by arrows 48. Thus, a positive bias DC voltage applied to switching circuit 40 couples antenna elements 14 and 16 and also antenna elements 12 and 18 in the manner shown in FIG. 3.

When switching circuit 40 is negatively biased pin diodes D1 and D4 are turned on, while pin diodes D2 and D3 are turned off. This results in a RF signal flow path through diode D4 and diode D1 of switching circuit 40 as is best indicated by arrows 50. Thus a negative bias DC voltage applied to switching circuit 40 couples antenna elements 12 and 14 and also antenna elements 16 and 18 in the manner shown in FIG. 2.

Inductor L2 has one terminal connected to the cathodes of pin diodes D1 and D3 and its other terminal connected to the cathodes of pin diodes D2 and D4. Inductor L2 blocks RF signal flow while allowing for transmission of the bias current through inductor L2 which turns either the combination of pin diodes D1 and D4 or the combination of pin diodes D2 and D3.

A +Vrf signal which is supplied to terminal 44 and −Vrf signal which is supplied to terminal 46 represent the required RF (radio frequency) drive signals for switching network 40. The −Vrf signal is 180 degrees out of phase relative to the +Vrf signal. A positive bias voltage results in the horizontal polarization illustrated in FIG. 3, while a negative bias voltage results in vertical polarization illustrated in FIG. 2.

It should be noted that the pin diodes D1, D2, D3 and D4 of switching network 40 are required to handle about one half of the power generated by network 40 when crossed-dipole antenna 10 is operational.

Other implementations of the present invention are possible and would incorporate substantially more antenna elements to provide for a finer degree of polarization control. The present invention could also incorporate circular polarization and make use of additional PIN diodes to turn off inputs so that reduced radar cross section is provided.

From the foregoing, it may readily be seen that the present invention comprises a new, unique and exceedingly useful crossed-dipole antenna and its associated switching network with polarization diversity which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A microwave antenna system capable of selectively generating a polarized output signal, comprising:

a generally rectangular shaped crossed-dipole antenna having first, second, third and fourth antenna elements, said first and second antenna elements being positioned at an upper portion of said crossed-dipole antenna and said third and fourth antenna elements being positioned at a lower portion of said crossed-dipole antenna, said first and fourth antenna elements being orientated generally orthogonally to one another and said second and third antenna elements being orientated generally orthogonally to one another;

voltage source means for providing a first voltage signal and a second voltage signal; and switching circuit means for receiving said first bias voltage and said second bias voltage, said switching circuit means, responsive to said first voltage signal, connecting said first antenna element to said second antenna element and said third antenna element to said fourth antenna element causing said crossed-dipole antenna to output a vertical linear polarized signal;

said switching circuit means, responsive to said second voltage signal, connecting said first antenna element to said third antenna element and said second antenna element to said fourth antenna element causing said crossed-dipole antenna to output a horizontal linear polarized signal.

2. The microwave antenna system of claim 1 wherein switching circuit means comprises:

a first inductor having a first terminal connected to said voltage source means and a second terminal connected to said second antenna element;

a first input terminal for receiving a first radio frequency drive signal;

a first capacitor having a first terminal connected to said first input terminal and a second terminal connected to the second terminal of said first inductor;

a first diode having an anode connected to said first antenna element and a cathode connected to the second terminal of said first inductor;

a second diode having an anode connected to the second terminal of said first inductor and a cathode connected to said fourth antenna element;

a second inductor having a first terminal connected to the anode of said first diode and a second terminal connected to the cathode of said second diode;

a third inductor having a first terminal connected to ground and a second terminal connected to said third antenna element;

a second input terminal for receiving a second radio frequency drive signal;

a second capacitor having a first terminal connected to said second input terminal and a second terminal connected to the second terminal of said third inductor;

a third diode having an anode connected to said first antenna element and a cathode connected to the second terminal of said third inductor; and a fourth diode having an anode connected to the second terminal of said third inductor and a cathode connected to said fourth antenna element.

3. The microwave antenna system of claim 2 wherein each of said first, second, third and fourth diodes comprises a pin diode.

4. A microwave antenna system capable of selectively generating a polarized output signal, comprising:

a generally rectangular shaped crossed-dipole antenna having first, second, third and fourth antenna elements, said first and second antenna elements being positioned at an upper portion of said crossed-dipole antenna and said third and fourth antenna elements being positioned at a lower portion of said crossed-dipole antenna, said first and fourth antenna elements being orientated generally orthogonally to one another and said second and third antenna elements being orientated generally orthogonally to one another;

a direct current voltage source for providing a positive direct current voltage signal and a negative direct current voltage signal; and a switching circuit connected to said direct current voltage source to receive said positive direct current voltage signal and said negative direct current voltage signal;

said switching circuit being connected to said first, second, third and fourth antenna elements of said crossed dipole antenna;

said switching circuit, responsive to said negative direct current voltage signal, connecting said first antenna element to said second antenna element and said third antenna element to said fourth antenna element causing said crossed-dipole antenna to output a vertical linear polarized signal;

said switching circuit means, responsive to said positive direct current voltage signal, connecting said first antenna element to said third antenna element and said second antenna element to said fourth antenna element causing said crossed-dipole antenna to output a horizontal linear polarized signal.

5. The microwave antenna system of claim 4 wherein switching circuit means comprises:

a first inductor having a first terminal connected to said direct current voltage source and a second terminal connected to said second antenna element;

a first input terminal for receiving a first radio frequency drive signal;

a first capacitor having a first terminal connected to said first input terminal and a second terminal connected to the second terminal of said first inductor;

a first diode having an anode connected to said first antenna element and a cathode connected to the second terminal of said first inductor;

a second diode having an anode connected to the second terminal of said first inductor and a cathode connected to said fourth antenna element;

a second inductor having a first terminal connected to the anode of said first diode and a second terminal connected to the cathode of said second diode;

a third inductor having a first terminal connected to ground and a second terminal connected to said third antenna element;

a second input terminal for receiving a second radio frequency drive signal;

a second capacitor having a first terminal connected to said second input terminal and a second terminal connected to the second terminal of said third inductor;

a third diode having an anode connected to said first antenna element and a cathode connected to the second terminal of said third inductor; and a fourth diode having an anode connected to the second terminal of said third inductor and a cathode connected to said fourth antenna element.

6. The microwave antenna system of claim 5 wherein each of said first, second, third and fourth diodes comprises a pin diode.

* * * * *